US006158325A

United States Patent [19]

Miyaji et al.

[11] Patent Number: 6,158,325

[45] Date of Patent: Dec. 12, 2000

[54] SWASH PLATE TYPE VARIABLE DISPLACEMENT COMPRESSOR

[75] Inventors: Toshikatsu Miyaji; Shinichiro Higashihara, both of Tochigi, Japan

[73] Assignee: Calsonic Corporation, Tokyo, Japan

[21] Appl. No.: 09/175,531

[22] Filed: Oct. 20, 1998

[30] Foreign Application Priority Data

Oct. 21, 1997 [JP] Japan ..... 9-288781

[51] Int. Cl.[7] ..... F01B 3/00; F01B 31/10

[52] U.S. Cl. ..... 92/12.2; 92/154

[58] Field of Search ..... 92/12.2, 71, 154; 417/222.2

[56] References Cited

U.S. PATENT DOCUMENTS

| | | | |
|---|---|---|---|
| 4,008,005 | 2/1977 | Hiraga | 417/269 |
| 4,712,982 | 12/1987 | Inagaki et al. | 92/12.2 |
| 5,063,829 | 11/1991 | Takao et al. | 92/71 |
| 5,105,728 | 4/1992 | Hayase et al. | 92/71 |
| 5,393,204 | 2/1995 | Kawahara | 417/269 |
| 5,586,870 | 12/1996 | Kawaguchi et al. | 417/222.2 |
| 5,674,054 | 10/1997 | Ota et al. | 417/269 |
| 5,706,716 | 1/1998 | Umemura | 92/165 |
| 5,749,712 | 5/1998 | Umemura | 417/249 |
| 5,785,503 | 7/1998 | Ota et al. | 92/71 |

FOREIGN PATENT DOCUMENTS

| | | |
|---|---|---|
| 0 554 791 | 8/1993 | European Pat. Off. . |
| 5-195949 | 8/1993 | Japan . |
| 6-101640 | 4/1994 | Japan . |
| 7-103138 | 4/1995 | Japan . |
| 8-61231 | 3/1996 | Japan . |

*Primary Examiner*—F. Daniel Lopez
*Attorney, Agent, or Firm*—Foley & Lardner

[57] ABSTRACT

A swash plate type compressor has a rotating assembly of a drive shaft, a drive plate mounted on the drive shaft and a swash plate unit linked with the drive plate through a hinge mechanism. The drive plate has a circular disk portion and a hinge supporting portion projecting from the disk portion. The drive plate is formed with an oil storage groove for improve lubrication and balance of the rotating assembly. The oil storage groove opens away from the swash plate unit, and extends so as to describe an arc of a circle at such a position that the oil storage groove extends between the axis of the drive shaft and the hinge supporting portion.

12 Claims, 2 Drawing Sheets

SWASH PLATE TYPE VARIABLE DISPLACEMENT COMPRESSOR

BACKGROUND OF THE INVENTION

The present invention relates to a compressor, and more specifically to a swash plate type compressor for compressing refrigerant gas in a refrigeration cycle of a vehicle air conditioning system.

A Japanese Patent Kokai Publication No. 7(1985)-103138 shows a conventional swash plate compressor including a drive plate fixed on a drive shaft, and a journal member swingably connected with a sleeve mounted on the drive shaft. The journal member includes a swash plate for translating rotational motion of the drive shaft into a rectilinear reciprocating motion of each piston. The drive plate and the journal member is linked by a hinge mechanism.

U.S. Pat. Nos. 5,706,716 and 5,749,712 also disclose swash plate type compressors. The explanation about swash plate compressors in these U.S. patents are hereby incorporated by reference.

SUMMARY OF THE INVENTION

The hinge mechanism is detrimental to the weight balance of the rotary assembly of the drive shaft, the drive plate and the journal member inclusive of the swash plate. In general, the center of gravity of the rotary assembly tends to be off the rotation axis toward the hinge mechanism notwithstanding balance weights provided on the drive plate and the journal member.

The imbalance of the rotary assembly tends to make the rotation unstable, promote one sided wear or abrasion of bearings such as radial bearings for the drive shaft and a thrust bearing for the drive plate, and deteriorates noises and vibrations.

Therefore, it is an object of the present invention to provide a swash plate compressor capable of improving lubrication around a drive plate and rotation balance of a rotary assembly without increasing a total weight.

According to the present invention, a swash plate type variable displacement compressor comprises:

- a plurality of pistons;
- a drive shaft;
- a drive plate mounted on the drive shaft in such a manner that the drive shaft and the drive plate rotate together; and
- a journal member which is swingably connected with a sleeve on the drive shaft, which is linked with the drive plate by a hinge mechanism, and which comprises a swash plate for translating rotational motion of the drive shaft into rectilinear motion of each piston.

The drive plate comprises a first half segment and a second half segment, the first half segment is linked with the journal member through the hinge mechanism, the first half segment comprises a first side surface facing away from the journal member and supporting a thrust bearing, and the drive plate comprises an oil storage groove formed in the first side surface of the first half segment.

DETAILED DESCRIPTION OF THE INVENTION

Figure 1:
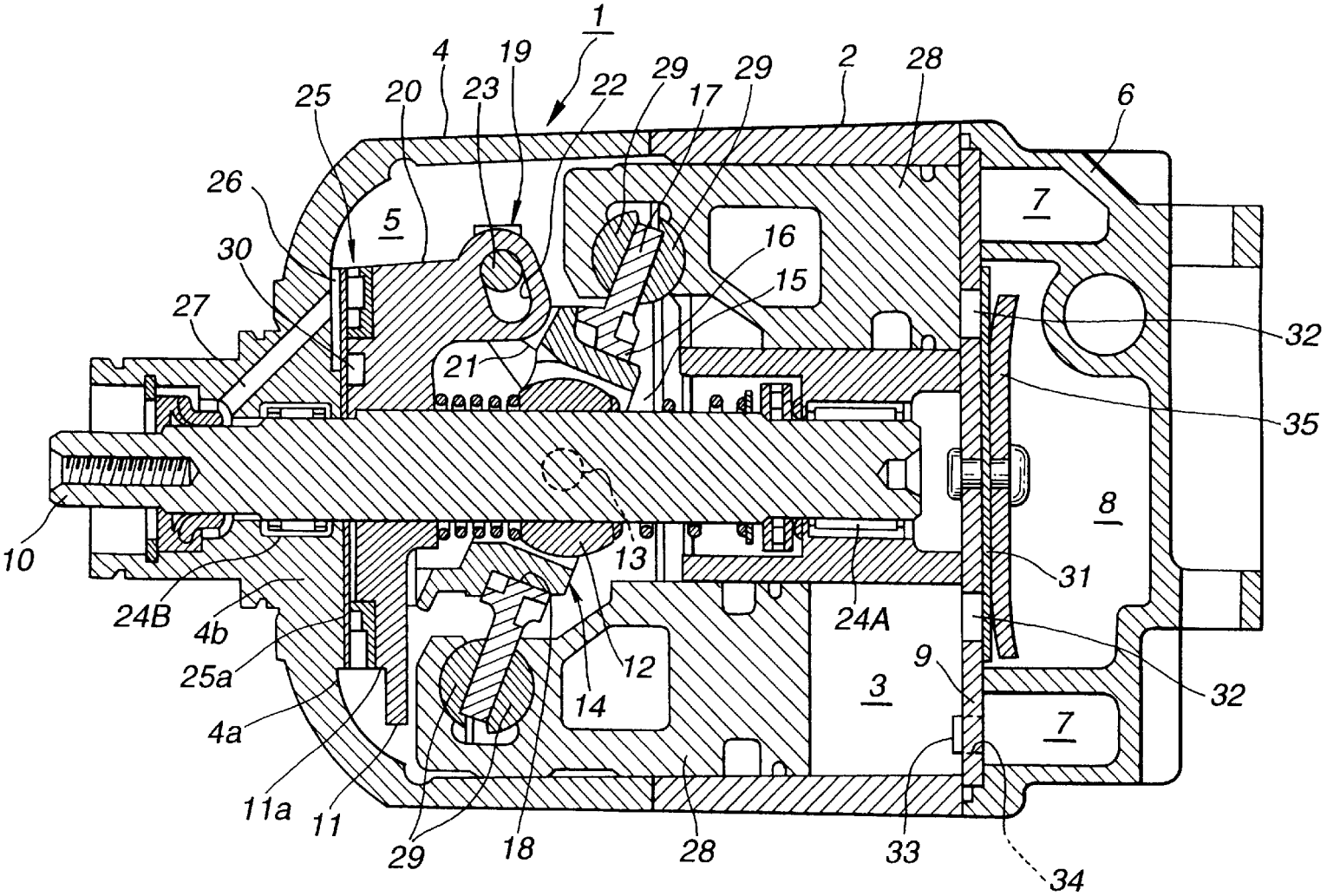
FIG. 1 is a sectional view of a swash plate compressor according to one embodiment of the present invention.
Figure 2:
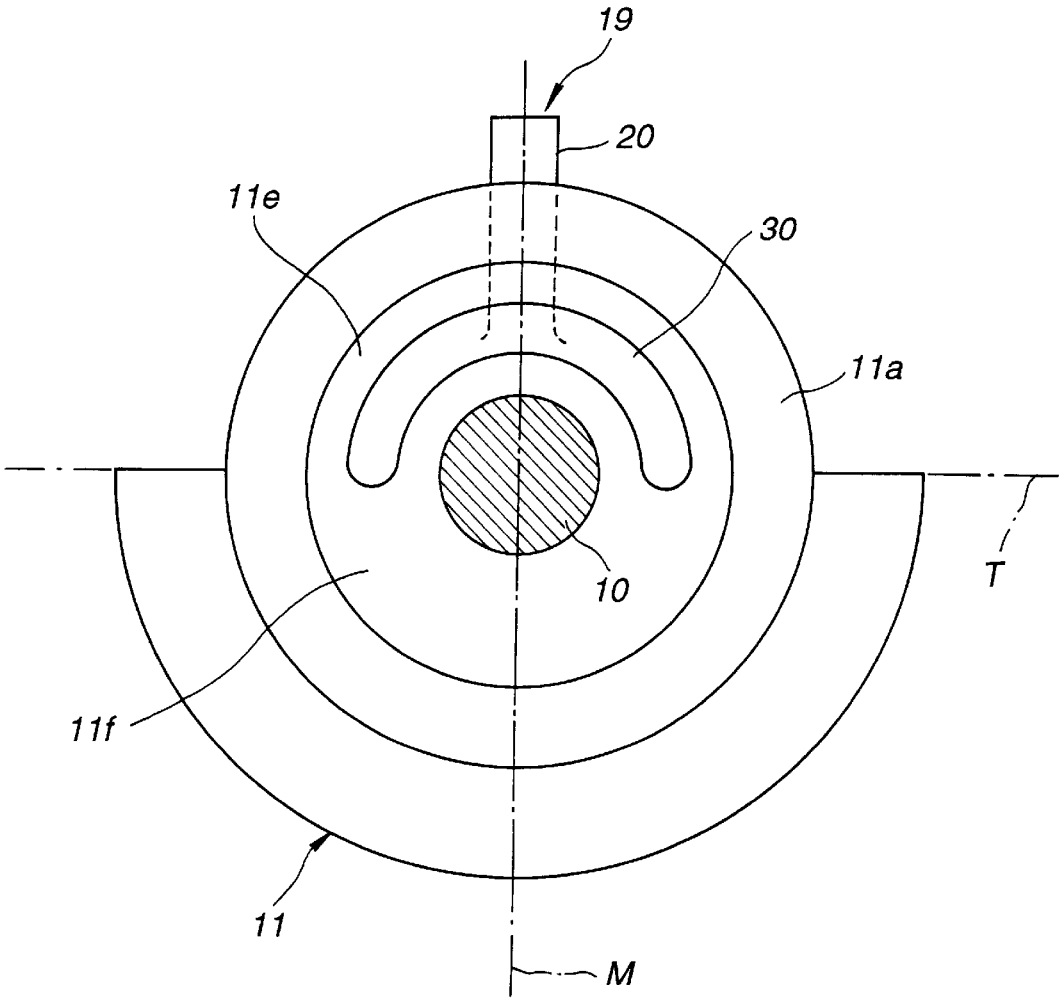
FIG. 2 is a side view showing a drive plate of the compressor shown in FIG. 1.

FIGS. 1 and 2 show a swash plate type variable displacement compressor according to one embodiment of the present invention.

A compressor housing 1 shown in FIG. 1 consists of a cylinder block 2 formed with a plurality of cylinder bores 3, a front housing 4 defining a crank chamber 5, and a rear housing 6. The front housing 4 is disposed on a front side of the cylinder block 2. The crank chamber 5 is formed between the front housing 4 and the cylinder block 2. The rear housing 6 is disposed on a rear side of the cylinder block 2. A valve plate 9 is interposed between the cylinder block 2 and the rear housing 6. The rear housing 6 forms a refrigerant suction chamber 7 and a refrigerant discharge chamber 8.

A drive shaft 10 extends into the crank chamber 5. In the crank chamber 5, there are provided a drive plate 11, and a journal member (or swash plate unit) comprising a journal 14 and a swash plate 17. The drive plate 11 is mounted on the drive shaft 10, and rotates as a unit with the drive shaft 10. In this example, the drive plate 11 is fixedly mounted on the drive shaft 10. The journal 14 is swingably mounted on a sleeve 12 which is slidably mounted on the drive shaft 10, and the journal 14 is swingably connected with the sleeve 12 by pins 13. The journal 14 has a boss 15 having an outside circumferential surface formed with a threaded portion 16. The swash plate 17 has a threaded hole 18. The swash plate 17 is fixed to the journal 14 with the threaded portion 16 screwed into the threaded hole 18 of the swash plate 17. The journal 14 is linked with the drive plate 11 by a hinge mechanism 19.

A hinge arm 20 projects from the drive plate 11 rearwards toward the journal 14. The hinge arm 20 is formed with an arched elongate hole 22 extending curvedly in an arc. A hinge arm 21 projects forwards from the journal 14 toward the drive plate 11. The hinge arm 20 is linked with the hinge arm 21 by a pin 23 received in the elongate hole 22. The pin 23, the elongate hole 22 and the hinge arms 20 and 21 constitute the hinge mechanism 19. The arched elongate hole 22 limits swing motion of the journal 14.

The drive shaft 10 passes through a center hole formed in a front end wall **4*b* of the front housing 4, and a center hole formed in the cylinder block 2. The drive shaft 10 is supported by the front housing 4 through a front shaft bearing (or radial bearing) 24B disposed in the center hole of the front housing 4, and by the cylinder block 2 through a rear shaft bearing (or radial bearing) 24A disposed in the center hole of the cylinder block 2**.

A thrust bearing 25 is interposed between the drive plate 11 and the front end wall **4*b* of the front housing 4. The drive plate 11 has an annular thrust receiving surface 11*a* facing forwards toward the front end wall 4*b* of the front housing 4. The hinge arm 20 projects rearwards toward the journal 14. The front end wall 4*b* of the front housing 4 has an annular thrust receiving surface 4*a* facing rearwards toward the drive plate 11. The thrust bearing 25 is disposed between the forward facing thrust receiving surface 11*a* of the drive plate 11 and the rearward facing thrust receiving surface 4*a* of the front housing 4. In this example, the thrust receiving surface 11*a* is formed so as to form a step, and the thrust receiving surface 4*a* is formed so as to form a step in the inside surface of the front end wall 4*b*. In this example, the thrust receiving surface 4*a* and 11*a* are flat, and arranged so that the axis of the drive shaft 10 is substantially perpendicular to each of the thrust receiving surfaces 4*a* and 11*a*. The thrust bearing 25 sustains axial load and limit axial movement of the drive plate 11**.

The thrust bearing 25 comprises a front bearing race **25*a* contacting with the thrust receiving surface 4*a* of the front housing 4. In this example, the front bearing race 25*a* is flat and annular, and has an outside diameter which is equal to the outside diameter of the thrust receiving surface 4***a*. The front bearing race 25*a* is in sliding contact with the thrust receiving surface 4*a*.

An oil collecting groove 26 is formed in the thrust receiving surface 4*a* of the front housing 4. The front housing 4 further has an oil passage 27 extending from the oil groove 26 to a vicinity of the front shaft bearing 24B. The oil passage 27 extends obliquely from a rear end opening in the oil groove 26 to a front end opening toward the drive shaft 10. The oil passage 27 can supply oil to the front shaft bearing 25B and an inner circumferential portion of the bearing race 25*a* of the thrust bearing 25.

A piston 28 is received in each of the cylinder bores 3 of the cylinder block 2, and linked with the swash plate 17 by a pair of shoes 29 confronting each other across the swash plate 17. In each piston 28, the peripheral portion of the swash plate 17 is sandwiched between the confronting shoes 29 received in a recess of the piston 28.

The inclination angle of the swash plate 17 is controlled by a pressure control valve mechanism (not shown) in accordance with the pressure in the crank chamber 5. The pressure in the crank chamber 5 is regulated in accordance with the pressure in the refrigerant suction chamber 7. This compressor can vary the discharge volume of the refrigerant by varying the inclination angle of the swash plate 17, and thereby varying the stroke of each piston 28.

An oil storage groove 30 is formed in the drive plate 11. The drive plate 11 has a front side surface facing toward the front bearing race 25*a* of the thrust bearing 25, and toward the front end wall 4*b* of the front housing 4. The oil storage groove 30 is depressed below the front side surface of the drive plate 11. The oil storage groove 30 opens toward the front bearing race 25*a*. In this example, the thrust receiving surface 11*a* is also depressed below the front side surface of the drive plate 11. The drive plate 11 is placed axially between the front end wall 4*b* of the front housing 4 and the journal 14, and the drive plate 11 has the oil storage groove 30 and the thrust receiving surface 11*a* on the front side facing toward the front end wall 4*b* of the front housing 4, and the hinge arm 20 on the rear side facing toward the journal 14.

The drive plate 11 has a first half segment 11*e* and a second half segment 11*f*, which are semicircular in this example. The hinge arm 20 is formed in the first semicircular half segment 11*e*. The oil storage groove 30 is formed in the first semicircular half segment 11*e*. In this example, the oil storage groove 30 is not formed in the second semicircular segment. In this example, the drive plate 11 is substantially symmetrical, in a manner of bilateral symmetry, with respect to an imaginary median plane M shown by a vertical one dot chain line in FIG. 2. The drive plate 11 has a center hole receiving the drive shaft 10. The median plane M contains the axis of the center hole of the drive plate 11. In this example, the hinge arm 20 is symmetrical with respect to the median plane M so that the hinge arm 20 can be divided by the median plane M into left and right equal halves so that each of the left and right halves is a mirror image of the other. The oil storage groove 30 is also symmetrical with respect to the median plane M so that the oil storage groove 30 can be divided by the imaginary median plane M into left and right equal groove segments so that each is a mirror image of the other. The drive plate 11 can be divided into the first semicircular segment and the second semicircular segment by an imaginary transverse plane T which contains the axis of the center hole of the drive plate 11, and which is perpendicular to the median plane M. As viewed in FIG. 2, the first semicircular half segment 11*e* is on the upper side of the imaginary transverse plane T, and the second semicircular half segment 11*f* is on the lower side of the imaginary transverse plane T.

The thrust receiving surface 11*a* is annular, and the oil storage groove 30 is surrounded by the annular thrust receiving surface 11*a* as shown in FIG. 2. The oil storage groove 30 extends so as to describe an arc of a circle concentric with the circular center hole of the drive plate 11 and with the annular thrust receiving surface 11*a*, around the axis of the drive shaft 10. In this example, the oil storage groove 30 extends so as to describe a half of a circle.

The oil storage groove 30 is defined between an outer wall and inner wall which both extends in a semicircle in parallel to each other around the axis of the drive shaft 10, and a width of the groove 30 is defined between the outer and inner walls. The bearing race 25*a* extends radially from a circular outer circumference to a circular inner circumference. In this example, the radius of the circular inner circumference of the bearing race 25*a* is smaller than a radial dimension from the axis of the center hole of the drive plate 11 to the inner wall of the oil storage groove 30. The front bearing race 25*a* extends radially inwardly beyond the oil storage groove 30, and covers the oil storage groove 30 entirely.

The compressor shown in FIG. 1 further includes a reed valve 31 for opening and closing discharge holes 32 of the valve plate 9, and a reed valve 33 for opening and closing a suction hole 34 of the valve plate 9. A retainer 35 supports and retains the reed valve 31 and limits the opening of the reed valve 31.

In the thus-constructed compressor, oil contain in the form of mist in the refrigerant adheres to the outer circumference of the thrust bearing 25, and infiltrates to the sliding surfaces of the thrust bearing 25. On the other hand, the oil collecting groove 26 catches the oil accumulated on the inside surface of the front end wall 4*b* of the front housing 4, and the oil passage 27 leads the oil to the shaft bearing 25B. However, the oil cannot readily reach the inner circumferential region surrounded by the thrust bearing 25, and the oil supply tends to become insufficient around the sliding contact interface between the inner circumference of the drive plate 11 and the drive shaft 10, and the secluded sliding contact interface between the bearing race 25*a* and the drive plate 11.

The oil storage groove 30 can improve the lubrication to the inner circumferential region surrounded by the thrust bearing 25. The oil storage groove 30 can store the oil and supply the oil to the sliding interface between the front side surface of the drive plate 11 and the front bearing race 25*a*, and the inner region around the drive shaft 10.

The oil storage groove 30 is formed in the first half segment 11*e* on the same side as the hinge mechanism 19. Therefore, the oil storage groove 30 reduces the mass of the first half segment 11*e*, and makes it possible to coincide the center of gravity of the rotary assembly of the drive shaft 10, the drive plate 11, the journal 14 and the swash plate 17, with the rotation axis of the drive shaft 10. This configuration can stabilize the rotation of the assembly, avoid partial or eccentric wear of the bearings 24A, 24B and 25, and reduce the noises and vibrations.

In the illustrated example, the drive plate 11 is substantially symmetrical so that the median plane M can divide the drive plate 11 into left and right equal halves having a substantially equal weight, and the center of gravity of the drive plate 11 lies on the median plane M.

What is claimed is:

1. A swash plate type variable displacement compressor comprising:

a plurality of pistons;

a drive shaft;

a hinge mechanism;

a drive plate fixedly mounted on the drive shaft;

a sleeve mounted to the drive shaft; and a journal member swingably connected to the sleeve and linked to the drive plate by the hinge mechanism, the journal member translating rotational motion of the drive shaft into rectilinear motion of each piston;

wherein the drive plate comprises a first half segment and a second half segment, the first half segment being linked with the journal member through the hinge mechanism and including hinge supporting portion for supporting the hinge, the first half segment including a first side surface facing away from the journal member and supporting a thrust bearing, and wherein the drive plate includes an oil storage groove formed only in the first side surface of the first half segment and extending along the a semicircular arc bisected by a center line passing through the hinge supporting mechanism.

2. The compressor as claimed in claim 1 wherein the drive plate includes a thrust receiving recess depressed below the first side surface of the drive plate for receiving the thrust bearing.

3. The compressor as claimed in claim 1 wherein the drive plate comprises a thrust receiving portion for supporting the thrust bearing, and the oil storage groove is located radially inside the thrust receiving portion.

4. A swash plate type variable displacement compressor comprising:

a compressor housing comprising a first end wall;

a plurality of pistons;

a hinge mechanism;

a drive shaft;

a sleeve mounted on the drive shaft;

a journal member swingably connected to the sleeve for translating rotational motion of the drive shaft into rectilinear motion of each piston;

a drive plate mounted on the drive shaft, and located axially between the first end wall of the housing and the journal member, for rotating with the drive shaft; and a thrust bearing disposed between the drive plate and the first end wall of the compressor housing, the thrust bearing comprising bearing elements, a first race disposed between the bearing elements and the first end wall of the compressor housing and a second race disposed between the bearing elements and the drive plate;

wherein the drive plate comprises a circular disk portion comprising a first semicircular half segment and a second semicircular half segment, the first semicircular half segment being linked to the journal member by the hinge mechanism and including a first side surface having an oil storage groove opening toward the first end wall of the housing and surrounded by the second race and being covered by an inner portion of the first race, the oil storage groove being formed only in the first semicircular half segment.

5. The compressor as claimed in claim 4 wherein the first and second semicircular half segments are bounded from each other by an imaginary transverse plane containing a rotation axis of the drive plate, the drive plate comprises a hinge supporting portion projecting from the first semicircular half segment so that an imaginary median plane intersecting the transverse plane at right angles along the axis of the drive plate passes through a middle of the hinge supporting portion, the oil storage groove extends in a form of an arc of a circle around the axis of the drive plate, and the oil storage groove is symmetrical with respect to the median plane.

6. The compressor as claimed in claim 5 wherein the drive plate comprises an annular thrust receiving surface abutting on the thrust bearing, and the oil storage groove is formed in an inner region surrounded by the annular thrust receiving surface.

7. The compressor as claimed in claim 6 wherein the drive plate is substantially symmetric with respect to the median plane so that the drive plate is divided by the imaginary median plane into left and right equal halves each of which is substantially a mirror image of the other.

8. The compressor as claimed in claim 4 wherein the first side surface of the first half segment includes an outer region extending between the oil storage groove and the second race of the thrust bearing, and an inner region extending between the oil storage groove and the drive shaft, the outer and inner regions of the first side surface of the first half segment both being in sliding contact with the first race of the thrust bearing.

9. The compressor as claimed in claim 4 wherein the drive plate includes a thrust receiving recess depressed below the first side surface of the drive plate for receiving the thrust bearing.

10. A swash plate variable displacement compressor comprising:

a compressor housing comprising a first end wall;

a plurality of pistons;

a drive shaft;

a journal member comprising a journal swingably connected to a sleeve slidably mounted on the drive shaft, and a swash plate fixedly mounted on the journal, for translating rotational motion of the drive shaft into rectilinear motion of each piston;

a drive plate mounted on the drive shaft so that the drive plate and the drive shaft rotate as a unit, the drive plate being located axially between the first end wall of the housing and the journal member, the drive plate comprising a first flat side surface extending radially and confronting the first end wall of the compressor housing;

a thrust bearing disposed between the drive plate and the first end wall of the compressor housing, the thrust bearing comprising a first lateral race on a housing's side, a second lateral race on a drive plate's side, and bearing elements confined between the first and second lateral races; and wherein the drive plate comprises a circular disk portion and a hinge supporting portion projecting from the disk portion toward the journal being linked with the journal, the drive plate being substantially symmetrical with respect to an imaginary median plane so that the drive plate is divided by the imaginary median plane into left and right equal halves each of which is a mirror image of the other, the drive plate including an oil storage groove opening toward the first end wall of the housing, the oil storage groove and the hinge supporting portion formed only on one side of an imaginary transverse plane intersecting the median plane at right angles along an axis of the drive plate, and the drive plate including an annular thrust receiving recess for receiving the second race and the bearing elements of the thrust bearing, the oil storage groove being surrounded by the annular thrust receiving recess, the oil storage groove and the thrust receiving recess being both depressed from the first flat side surface of the drive plate.

11. The compressor as claimed in claim 10 wherein the first flat side surface of the drive plate is in sliding contact with the first race of the thrust bearing.

12. A swash plate type variable displacement compressor comprising:

a compressor housing comprising a first end wall;

a plurality of pistons;

a hinge mechanism;

a drive shaft;

a sleeve mounted to the drive shaft;

a journal member swingably connected to the sleeve for translating rotational motion of the drive shaft into rectilinear motion of each piston;

a drive plate, mounted on the drive shaft and located axially between the first end wall of the housing and the journal member, for rotating with the drive shaft;

a thrust bearing disposed between the drive plate and the first end wall of the compressor housing;

wherein the drive plate comprises a circular disk portion comprising a first semicircular half segment and a second semicircular half segment, the first semicircular half segment being linked to the journal member with the hinge mechanism and including a first side surface having an oil storage groove opening toward the first end wall of the housing, the first and second semicircular half segments being bounded from each other by an imaginary transverse plane containing a rotation axis of the drive plate, the drive plate including a hinge supporting portion projecting from the first semicircular half segment so that an imaginary median plan intersecting the transverse plane at right angles along the axis of the drive plate passes through a middle of the hinge supporting portion, the oil storage groove extending in the form of an arc of a circle around the axis of the drive plate, and the oil storage groove is symmetrical with respect to the median plane;

wherein the drive plate includes an annular thrust receiving surface abutting on the thrust bearing, and the oil storage groove being formed in an inner region surrounded by the annular thrust receiving surface;

wherein the thrust bearing includes a first race contacting the first end wall of the compressor housing and extending radially inwardly and over the oil storage groove, and a second race contacting with the thrust receiving surface of the drive plate; and wherein the first race extends radially inwardly from an outer circumference to an inner circumference, the second race extends radially inwardly from an outer circumference to an inner circumference, the oil storage groove extends radially inwardly from an outer circumference to an inner circumference, the oil storage groove is surrounded by the second race, a radial distance of the inner circumference of the first race from the axis of the drive shaft is smaller than a radial distance of the inner circumference of the first race from the axis of the drive shaft is smaller than a radial distance of the inner circumference of the second race from the axis of the drive shaft and smaller than a radial distance of the inner circumference of the oil storage groove.

* * * * *